US007157998B2

(12) United States Patent
Tagami et al.

(10) Patent No.: US 7,157,998 B2
(45) Date of Patent: Jan. 2, 2007

(54) FERRITE CORE, DEFLECTION YOKE, AND COLOR PICTURE TUBE APPARATUS

(75) Inventors: Etsuji Tagami, Takatsuki (JP); Akitsugu Ishii, Muko (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 137 days.

(21) Appl. No.: 11/098,319

(22) Filed: Apr. 4, 2005

(65) Prior Publication Data

US 2005/0225414 A1 Oct. 13, 2005

(30) Foreign Application Priority Data

Apr. 9, 2004 (JP) ..... 2004-115746

(51) Int. Cl.
*H01F 7/00* (2006.01)
*H01J 29/70* (2006.01)

(52) U.S. Cl. ..... 335/210; 313/440

(58) Field of Classification Search ..... 335/210–214; 313/440

See application file for complete search history.

(56) References Cited

U.S. PATENT DOCUMENTS 6,281,623 B1 8/2001 Suzuki et al.
6,914,505 B1 * 7/2005 Taniwa ..... 335/210
6,949,875 B1 * 9/2005 Hwang et al. ..... 313/440
6,979,945 B1 * 12/2005 Lee ..... 313/440
2004/0145296 A1 * 7/2004 Lee ..... 313/440
2005/0046328 A1 * 3/2005 Tagami ..... 313/440

FOREIGN PATENT DOCUMENTS

| | | |
|---|---|---|
| EP | 1 162 643 | 12/2001 |
| EP | 1 369 894 | 12/2003 |
| JP | 61-56757 | 4/1986 |
| JP | 2004-14349 | 1/2004 |
| WO | WO 99/26270 | 5/1999 |

* cited by examiner

*Primary Examiner*—Ramon M. Barrera
(74) *Attorney, Agent, or Firm*—Hamre, Schumann, Mueller & Larson, P.C.

(57) ABSTRACT

A ferrite core constituting a deflection yoke has a plurality of ridge-shaped convex portions on an inner circumferential surface. In a cross-section orthogonal to a center axis, the cross-sectional shape of an outer circumferential surface of the ferrite core is substantially circular, and the cross-sectional shape of an inner circumferential surface of the ferrite core excluding the convex portions is substantially circular in the vicinity of an end on a large diameter side of the ferrite core and is substantially rectangular in a portion between the vicinity of an end on a small diameter side and the vicinity of the end on the large diameter side. This can provide a low-cost color picture tube apparatus with a reduced deflection power and satisfactory productivity.

6 Claims, 18 Drawing Sheets

FERRITE CORE, DEFLECTION YOKE, AND COLOR PICTURE TUBE APPARATUS

BACKGROUND OF THE INVENTION

1. Field of the Invention

The present invention relates to a color picture tube apparatus used in a television, a computer display, or the like. Furthermore, the present invention relates to a deflection yoke and a ferrite core used in the color picture tube apparatus.

2. Description of the Related Art

In order to reduce the required deflection power and suppress the heat generated by a deflection yoke, JP61 (1986)-56757U discloses a so-called slot core in which a plurality of convex portions protruding toward a tube axis of a picture tube are provided on an inner surface of a ferrite core constituting a deflection yoke. FIG. 17 shows a cross-sectional view of the deflection yoke with the slot core, taken along a surface vertical to the tube axis at a position close to an electron gun. As shown in FIG. 17, a tube axis of the picture tube on which the deflection yoke is mounted is a Z-axis, a horizontal axis orthogonal to the Z-axis is an X-axis, and a vertical axis orthogonal to the Z-axis and the X-axis is a Y-axis. In FIG. 17, reference numeral 90 denotes a ferrite core, and 91 denotes a plurality of convex portions provided on an inner surface of the ferrite core 90. Windings are inserted in grooves between the convex portions 91 adjacent to each other in a circumferential direction, whereby a horizontal deflection coil 97 and a vertical deflection coil 98 are wound therein. Reference numeral 99 denotes an insulating frame for insulating the horizontal deflection coil 97 from the vertical deflection coil 98. Each convex portion 91 extends over the entire region in a tube axis direction from an end on an electron gun side of the ferrite core 90 to an end on a screen side thereof, along a plane that includes the tube axis. By providing such convex portions 91, compared with the case where the convex portions 91 are not provided, the ferrite core 90 can be brought close to the picture tube. Therefore, the deflection efficiency can be enhanced, which is advantageous for reducing a deflection power. Furthermore, since a magnetic flux is unlikely to cross the coils 97, 98, an eddy current loss is reduced, and the heat generated by the deflection yoke also can be decreased.

The deflection yoke is mounted on an outer circumferential surface of a funnel of the color picture tube. The cross-sectional shape of the outer circumferential surface of the funnel in a portion where the deflection yoke is mounted, taken along a surface vertical to the tube axis, generally used to be circular in a conventional example. However, a funnel has come to be used in which the cross-sectional shape of a diameter-changing portion is varied gradually from a circular shape to a substantially rectangular shape in a direction from a neck side to a phosphor screen side, except for the neck in which an electron gun is housed, so as to be matched with a rectangular display screen on which a phosphor screen is formed. In order to accommodate this configuration, as shown in FIG. 18, a deflection yoke is proposed, in which each cross-sectional shape of the ferrite core 90, the horizontal deflection coil 97, the vertical deflection coil 98, and the insulating frame 99 is set to be substantially rectangular (e.g., see International Publication No. WO 99/26270). In this deflection yoke, an envelope-curve 94 connecting tip ends of the convex portions 91 formed on the inner circumferential surface of the ferrite core 90 also is substantially rectangular. Thus, by setting the cross-sectional shape of each component constituting the deflection yoke to be substantially rectangular in accordance with the cross-sectional shape of the outer circumferential surface of the substantially rectangular funnel, the deflection yoke, in particular, the convex portions 91 of the ferrite core 90 can be brought close to an electron beam. Therefore, the deflection sensitivity is enhanced further, and the deflection power can be reduced further.

Furthermore, JP2004-14349A proposes a deflection yoke as shown in FIG. 19. This deflection yoke is different from that shown in FIG. 18 in that the cross-sectional shape on an XY-plane of the inner circumferential surface of the ferrite core 90 excluding the convex portions 91 (smooth virtual curved surface obtained by successively connecting bottom surfaces of grooves between the convex portions 91) and the cross-sectional shape on the XY-plane of the outer circumferential surface of the ferrite core 90 are both circular. The envelope curve 94 connecting the tip ends of the convex portions 91 is substantially rectangular so as to be matched with the cross-sectional shape of the outer circumferential surface of a funnel on which the deflection yoke is to be mounted. Thus, in the deflection yoke shown in FIG. 19, the deflection sensitivity can be enhanced, and the deflection power can be reduced, in the same way as in the deflection yoke shown in FIG. 18.

Furthermore, the ferrite core 90 used in the deflection yoke shown in FIG. 19 has a circular cross-sectional shape on the XY-plane, except for the envelope curve 94 connecting the tip ends of the convex portions 91. Therefore, the ferrite core 90 shown in FIG. 19 can be designed more easily and has more satisfactory size stability, compared with the ferrite core 90 used in the deflection yoke shown in FIG. 18.

Furthermore, in a process of sintering a ferrite core, the ferrite core 90 shown in FIG. 19 has an advantage compared with that shown in FIG. 18. The reason for this is as follows. When a ferrite core is sintered, an uncured ferrite core needs to be held by a mortar-shaped fixing jig having an opening, which can come into contact with the outer circumferential surface of the ferrite core over the entire circumference. Regarding the ferrite core shown in FIG. 18, a dedicated fixing jig matched with the outer circumferential surface of the substantially rectangular cross-section is required. In contrast, regarding the ferrite core shown in FIG. 19, irrespective of the outer diameter of the ferrite core, a general-purpose common fixing jig having a substantially circular conical surface can be used. Furthermore, since a common fixing jig can be used, the heat capacity of the fixing jig becomes the same, and even in the case of sintering a plurality of kinds of ferrite cores simultaneously, it is easy to set sintering conditions. Thus, in the ferrite core shown in FIG. 19, the sintering process can be performed efficiently at a low cost. Furthermore, the number of fixing jigs accommodated in a sintering furnace also can be kept constant with a satisfactory efficiency.

However, in the ferrite core shown in FIG. 19, irrespective of the position in the tube axis direction, each cross-sectional shape of the inner circumferential surface excluding the convex portions 91 and the outer circumferential surface is circular, whereas the envelope curve 94 connecting the tip ends of the convex portions 91 is substantially rectangular. Therefore, when the tip ends of the convex portions 91 are brought close to the outer circumferential surface of the funnel, the protrusion length of the convex portions 91 becomes large, and the convex portions 91 become chipped, whereby the yield in the course of production of a ferrite core decreases.

SUMMARY OF THE INVENTION

The present invention solves the above-mentioned conventional problems, and its object is to provide a low-cost color picture tube apparatus having a ferrite core provided with ridge-shaped convex portions on an inner circumferential surface, and having satisfactory deflection sensitivity, a reduced deflection power, and satisfactory productivity. Another object of the present invention is to provide a deflection yoke and a ferrite core for realizing such a color picture tube apparatus.

A ferrite core of the present invention has a substantially funnel shape and includes a plurality of convex portions arranged on an inner circumferential surface in a circumferential direction. All the convex portions have a ridge shape in a direction connecting an end on a small diameter side of the ferrite core to an end on a large diameter side thereof. In a cross-section orthogonal to a center axis of the ferrite core, a cross-sectional shape of an outer circumferential surface of the ferrite core is substantially circular. In a cross-section orthogonal to the center axis, a cross-sectional shape of an inner circumferential surface of the ferrite core excluding the plurality of convex portions is substantially circular in a vicinity of the end on the large diameter side and is substantially rectangular in a portion between the vicinity of the end on the small diameter side and the vicinity of the end on the large diameter side. Herein, the "vicinity of an end on a large (small) diameter side" means that, when a chamfered portion and the like are formed at an end on a large (small) diameter side, a region where the chamfered portion and the like are formed is excluded.

A deflection yoke of the present invention includes: the above-mentioned ferrite core of the present invention; a vertical deflection coil for generating a vertical deflection magnetic field substantially along a first axis orthogonal to the center axis; a horizontal deflection coil for generating a horizontal deflection magnetic field substantially along a second axis orthogonal to the center axis and the first axis; and an insulating frame for insulating the vertical deflection coil from the horizontal deflection coil.

Furthermore, a color picture tube apparatus of the present invention includes: an envelope composed of a front panel and a funnel; an electron gun for emitting an electron beam, housed in a neck of the funnel; and a deflection yoke for deflecting the electron beam in a horizontal direction and a vertical direction, mounted on an outer circumferential surface of the funnel. The deflection yoke is the above-mentioned deflection yoke of the present invention.

These and other advantages of the present invention will become apparent to those skilled in the art upon reading and understanding the following detailed description with reference to the accompanying figures.

DESCRIPTION OF THE PREFERRED EMBODIMENTS

The ferrite core of the present invention is a slot core provided with a plurality of ridge-shaped convex portions on an inner circumferential surface. Irrespective of this configuration, the productivity of the ferrite core is satisfactory and the cost thereof is low. The ferrite core also exhibits the effect, intrinsic to a slot core, of enhancing a deflection efficiency and reducing a deflection power.

Furthermore, in the deflection yoke and the color picture tube apparatus of the present invention, low power consumption, low heat generation, low cost, and reduction in weight can be realized.

Hereinafter, the present invention will be described by way of illustrative embodiments with reference to the drawings.

Figure 1:
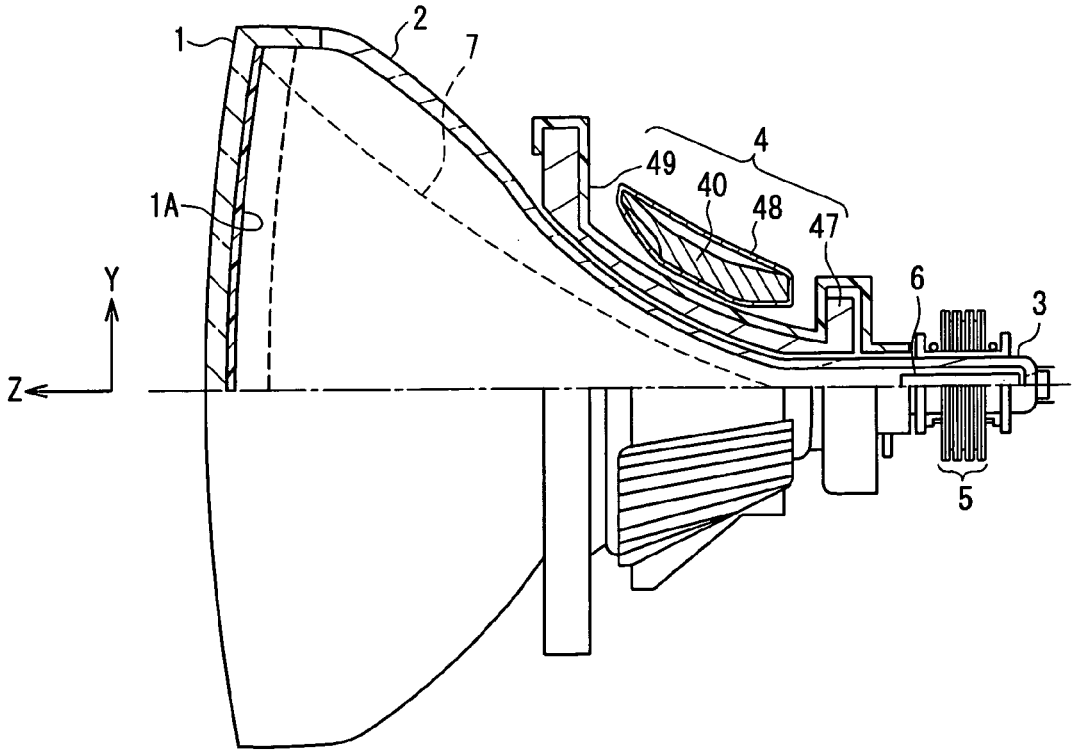
FIG. 1 is a partial cross-sectional view of an example of a color picture tube apparatus according to the present invention.

FIG. 1 is a partial cross-sectional view showing a schematic configuration of an example of a color picture tube apparatus according to the present invention.

As shown in FIG. 1, a color picture tube of the color picture tube apparatus includes an envelope in which a front panel 1 with a phosphor screen 1A formed on an inner surface is connected to a funnel 2. In a neck 3 that is a thinnest portion of the funnel 2, an electron gun 6 emitting three electron beams 7 (three electron beams 7 are arranged in one line in a horizontal direction, so that only one electron beam on the front side is shown in FIG. 1) is housed. As shown in FIG. 1, an XYZ rectangular coordinate system is set, in which a tube axis of the color picture tube is a Z-axis, a horizontal axis orthogonal to the Z-axis is an X-axis, and a vertical axis orthogonal to the X-axis and the Z-axis is a Y-axis.

On an outer circumferential surface in a portion where an outer diameter between a connection portion of the funnel 2 with respect to the front panel 1, and the neck 3 is varied, a deflection yoke 4 is mounted. The deflection yoke 4 includes a horizontal deflection coil 47, a vertical deflection coil 48, and a ferrite core 40. The horizontal deflection coil 47 generates a horizontal deflection magnetic field substantially along the Y-axis, and the vertical deflection coil 48 generates a vertical deflection magnetic field substantially along the X-axis. The three electron beams 7 emitted from the electron gun 6 are deflected in horizontal and vertical directions by the horizontal deflection magnetic field and the vertical deflection magnetic field to scan the phosphor screen 1A. An insulating frame 49 made of resin is provided between the horizontal deflection coil 47 and the vertical deflection coil 48. The insulating frame 49 has functions of maintaining an electrical insulation state between the horizontal deflection coil 47 and the vertical deflection coil 48, and supporting both the deflection coils 47, 48.

On an outer circumferential surface of the neck 3, a Convergence and Purity Unit (CPU) 5 for adjusting static convergence and purity of the electron beams at a center of a screen is provided. The CPU 5 includes dipole, quadrupole, and hexapole magnet rings for applying a magnetic field to the electron beams, and is attached to the outer circumferential surface of the neck 3 of the funnel 2 in which the electron gun 6 is housed.

Next, the deflection yoke 4 to be mounted on the color picture tube apparatus of the present invention will be described in more detail.

Embodiment 1

Figure 2:
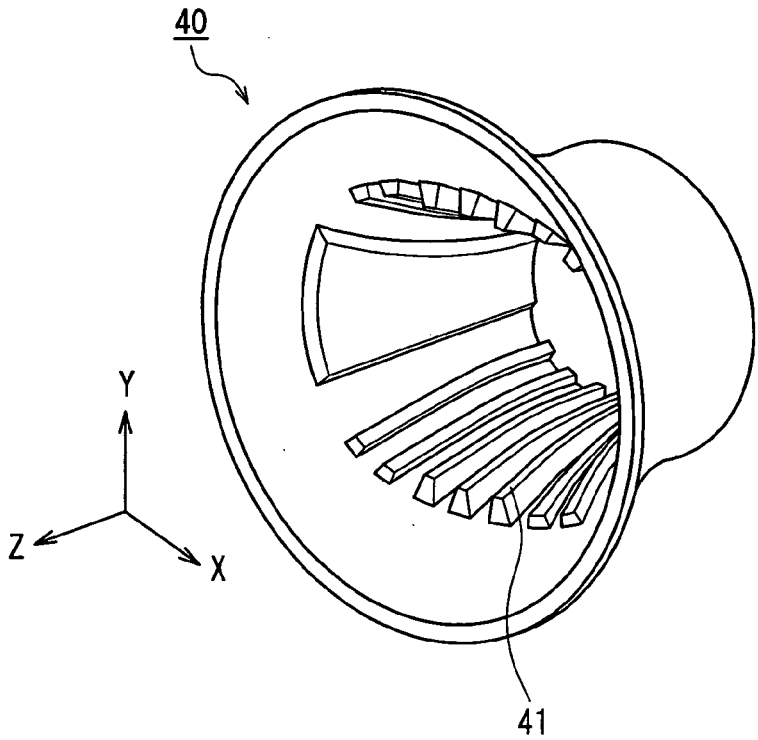
FIG. 2 is a perspective view of a ferrite core used in a deflection yoke according to Embodiment 1 of the present invention.

FIG. 2 is a perspective view of the ferrite core 40 used in the deflection yoke according to Embodiment 1 of the present invention. The ferrite core 40 is produced by sintering ferrite that is a magnetic material into a substantially funnel shape as a whole. Herein, the "substantially funnel shape" refers to a configuration in which an outer diameter and an inner diameter increase (or decrease) from one end to the other end in a center axis direction when viewed macroscopically. Minute protrusions and dents may be present on an outer circumferential surface, an inner circumferential surface, and an end face in the center axis direction. The ferrite core 40 is mounted on the color picture tube so that the center axis of the ferrite core 40 is matched with the Z-axis of the color picture tube. Thus, the center axis of the ferrite core 40 will be referred to as the Z-axis. FIG. 2 also shows XYZ-axes of the color picture tube on which the ferrite core 40 is to be mounted.

Figure 3:
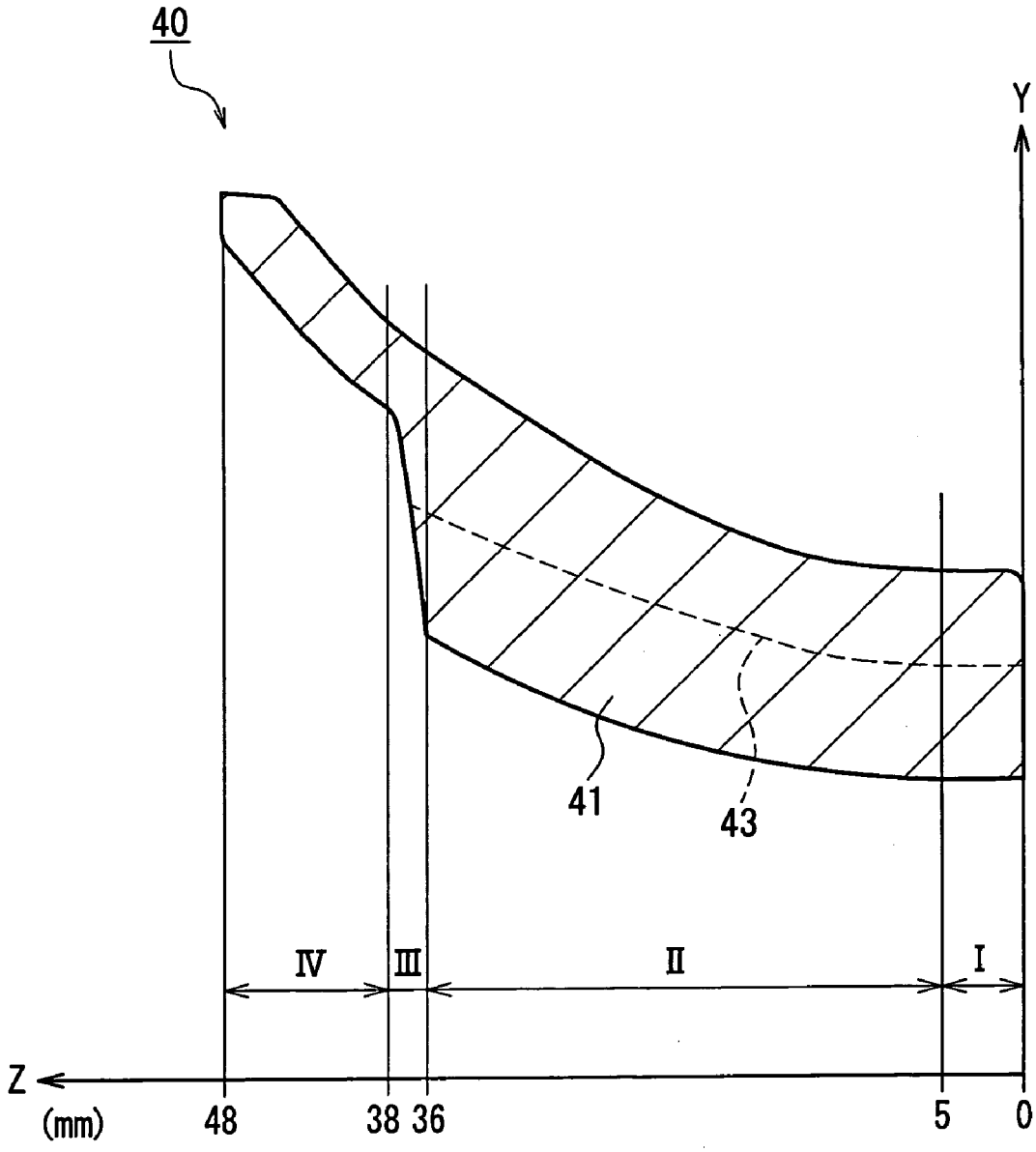
FIG. 3 is a partial cross-sectional view of the ferrite core according to Embodiment 1 of the present invention, taken along a surface including a center axis and a vertical axis.

FIG. 3 is a partial cross-sectional view of the ferrite core 40 according to Embodiment 1, taken along a surface (YZ-plane) including the Z-axis and the vertical axis (Y-axis). The cross-sectional shape of the ferrite core 40 on the YZ-plane is symmetrical with respect to the Z-axis, so that only a cross-sectional shape on one side with respect to the Z-axis is shown. As shown in FIG. 3, it is assumed that a position of an end on a small diameter side of the ferrite core 40 is Z=0, and a larger diameter side therefrom is a positive direction of the Z-axis. The size (length) in the Z-axis direction of the ferrite core 40 in Embodiment 1 is 48 mm.

Figure 4:
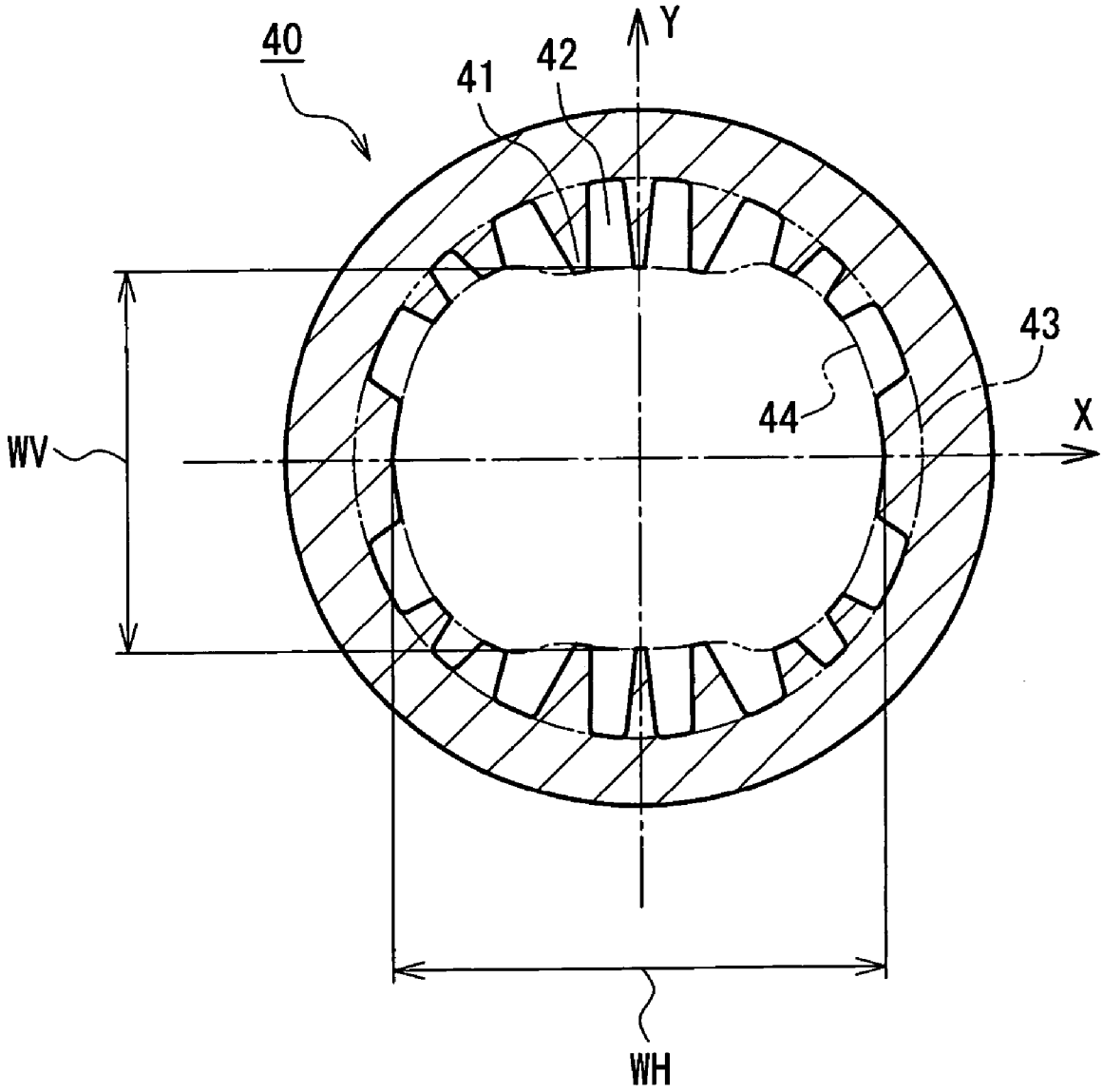
FIG. 4 is a cross-sectional view of the ferrite core according to Embodiments 1 and 2 of the present invention, taken along a surface vertical to a center axis at a position in the vicinity of an end on a small diameter side.
Figure 5:
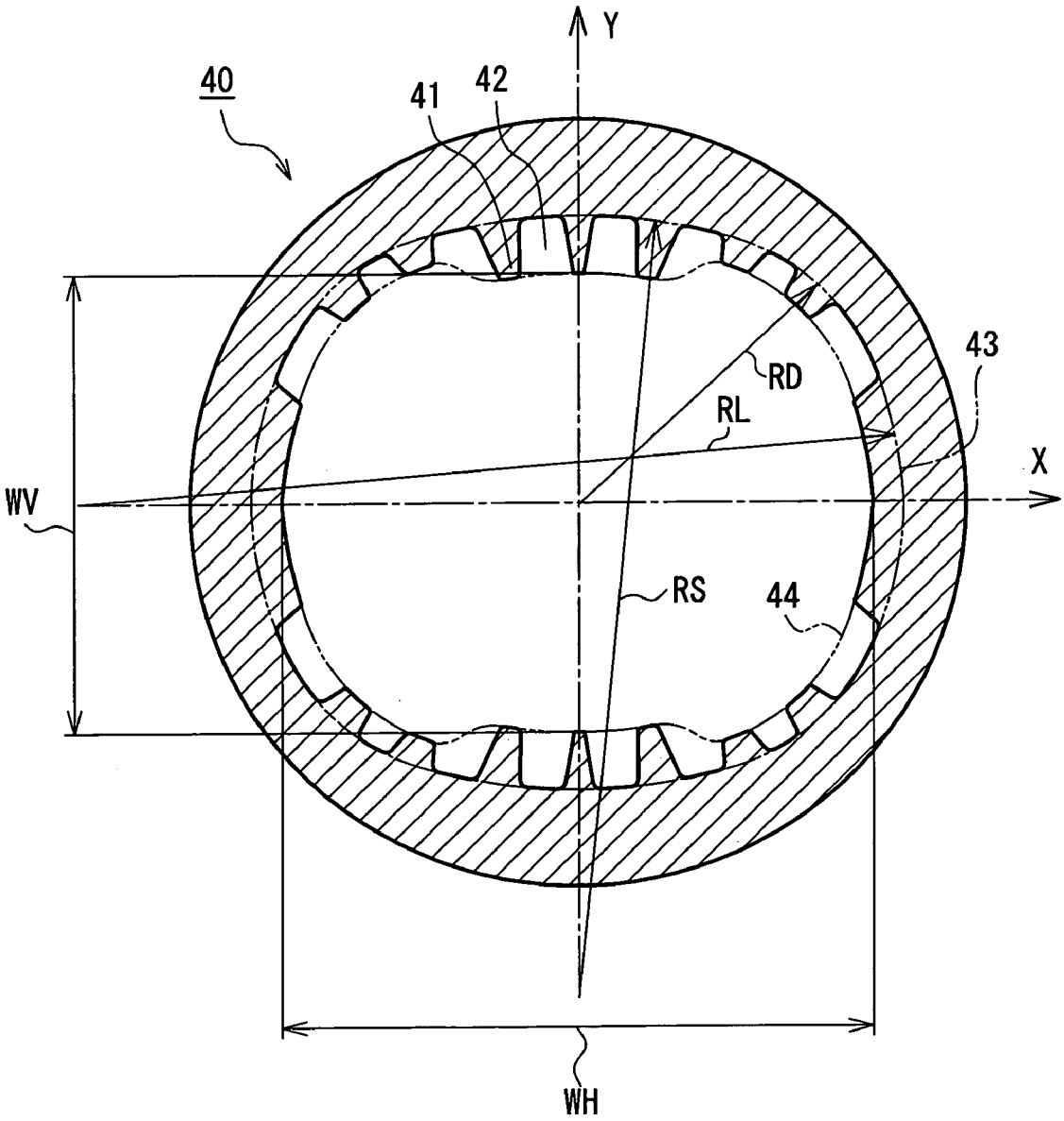
FIG. 5 is a cross-sectional view of the ferrite core according to Embodiments 1 and 2 of the present invention, taken along a surface vertical to the center axis in a substantially center portion in a center axis direction.
Figure 6:
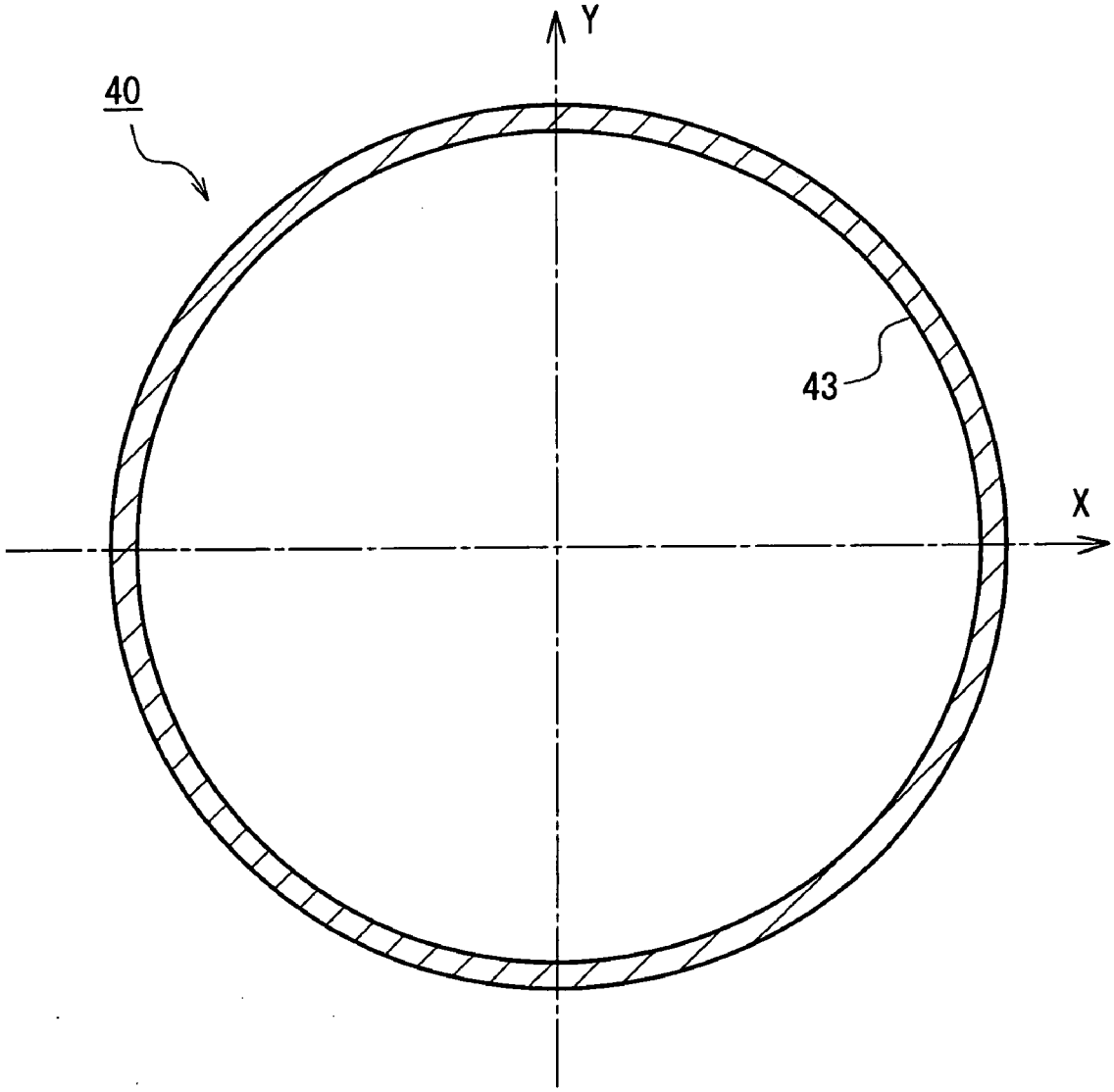
FIG. 6 is a cross-sectional view of the ferrite core according to Embodiment 1 of the present invention, taken along a surface vertical to the center axis at a position in the vicinity of an end on a large diameter side.

FIG. 4 is a cross-sectional view of the ferrite core 40, taken along a surface (XY-plane) vertical to the Z-axis at a position (Z=3 mm) in the vicinity of an end on a small diameter side. FIG. 5 is a cross-sectional view of the ferrite core 40 on the XY-plane at a substantially center position (Z=25 mm). FIG. 6 is a cross-sectional view of the ferrite core 40 on the XY-plane at a position (Z=43 mm) in the vicinity of an end on a large diameter side.

As shown in FIGS. 2 to 6, the ferrite core 40 has a plurality of convex portions 41 arranged on an inner circumferential surface in a circumferential direction. Each convex portion 41 protrudes substantially toward the Z-axis, and is formed in a ridge shape substantially along a plane that includes the Z-axis. In the Z-axis direction, the convex portions 41 are formed in a range of the end on the small diameter side (Z=0 mm) to a position of Z=36 mm, and are not formed in a range of Z=38 to 48 mm in the vicinity of the end on the large diameter side.

In the XY cross-sections as shown in FIGS. 4 to 6, the cross-sectional shape of an inner circumferential surface 43 of the ferrite core 40 excluding the plurality of convex portions 41 is substantially circular in the vicinity of the end on the small diameter side of the ferrite core 40 shown in FIG. 4 and in the vicinity of the end on the large diameter side of the ferrite core 40 shown in FIG. 6, and substantially rectangular in a portion between the vicinity of the end on the small diameter side and the vicinity of the end on the large diameter side as shown in FIG. 5. The "inner circumferential surface 43 of the ferrite core 40 excluding the plurality of convex portions 41" refers to a smooth virtual curved surface obtained by successively connecting bottom surfaces of grooves 42 between the convex portions 41 in a cross-section in which the convex portions 41 are formed as shown in FIGS. 4 and 5, and refers to the inner circumferential surface of the ferrite core 40 in a cross-section in which the convex portions 41 are not formed as shown in FIG. 6. In Embodiment 1, the cross-sectional shape of the inner circumferential surface 43 in the XY cross-section is substantially circular (see FIG. 4) in a range (region I) of Z=0 to 5 mm on the small diameter side, substantially rectangular (see FIG. 5) in a range (region II) of Z=5 to 36 mm, and substantially circular (see FIG. 6) in a range (region IV) of Z=38 to 48 mm on the large diameter side. In the range (region III) of Z=36 to 38 mm, the cross-sectional shape of the inner circumferential surface 43 gradually changes from a substantially rectangular shape to a substantially circular shape. The cross-sectional shape of the inner circumferential surface 43 being "substantially rectangular" includes the case where the cross-sectional shape is obtained by combining three arcs having radii RL, RS, and RD respectively having centers on the X-axis, Y-axis, and diagonal axis, as shown in FIG. 5.

Furthermore, as shown in FIGS. 4 and 5, in the XY cross-section, assuming that the size on the X-axis (first axis) of a closed curve (envelope curve of the tip ends of the convex portions 41) 44 obtained by successively connecting the tip ends of the plurality of convex portions 41 is WH, and the size on the Y-axis (second axis) of the closed curve is WV, a relationship WH>WV is satisfied. The closed curve 44 is not defined in the XY cross-section without the convex portions 41 (e.g., FIG. 6). As shown in FIGS. 4 and 5, when only a portion of the closed curve 44 on an upper side from the X-axis is paid attention to, this portion has a substantially M-letter shape. More specifically, the size of the closed curve 44 in the Y-axis direction becomes maximum at two points on the X-axis slightly apart from the Y-axis.

Furthermore, in the XY cross-sections as shown in FIGS. 4 to 6, the cross-sectional shape of the outer circumferential surface of the ferrite core 40 is substantially circular irrespective of the position on the Z-axis.

Figure 7:
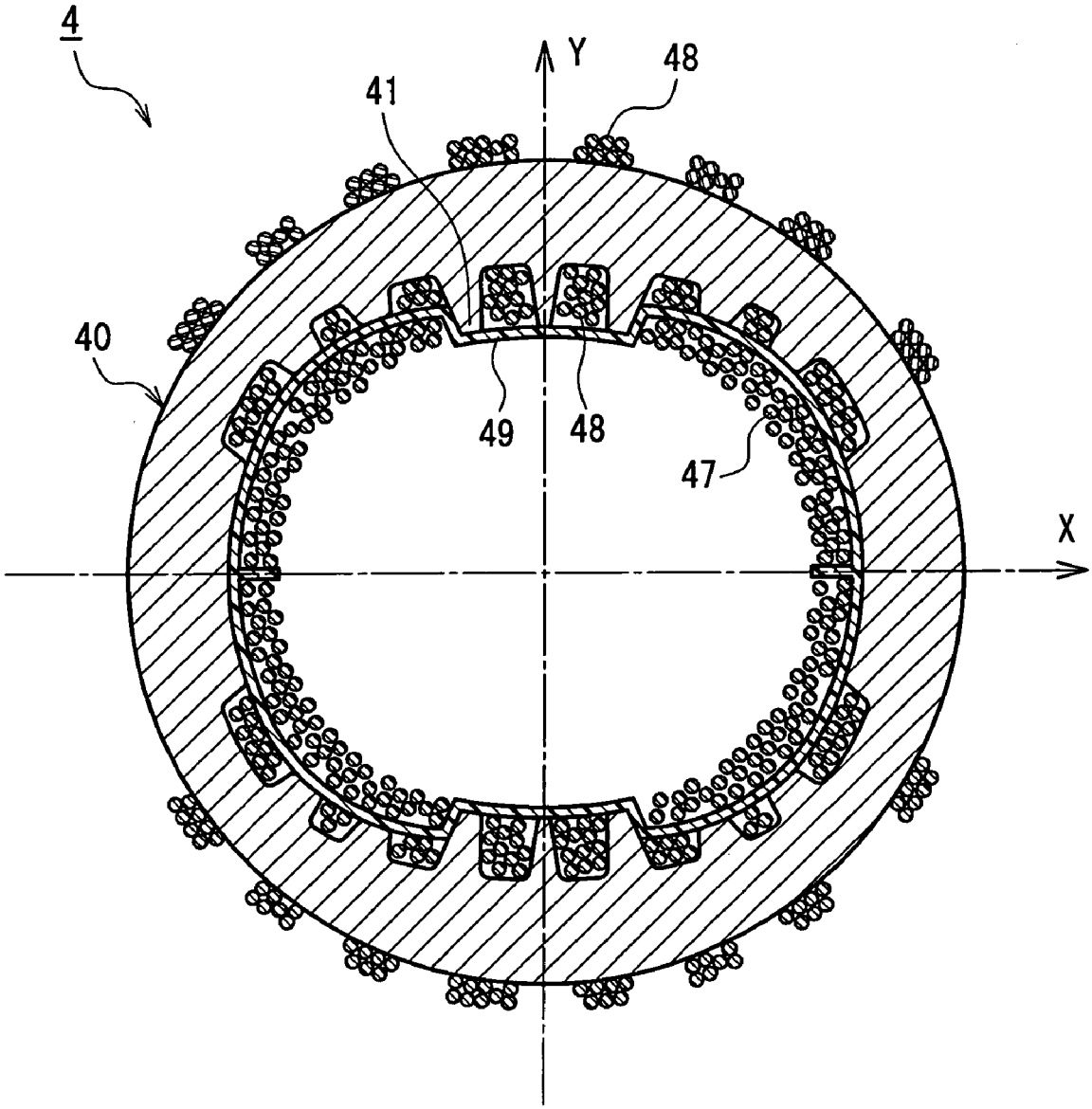
FIG. 7 is a cross-sectional view of a deflection yoke according to Embodiments 1 and 2 of the present invention, taken along a surface vertical to a center axis in a substantially center portion in a center axis direction.

FIG. 7 is an XY cross-sectional view at a position (Z=25 mm) of the deflection yoke 4 according to Embodiment 1 provided with the ferrite core 40. As shown in FIG. 7, the vertical deflection coil 48 is wound in a toroidal shape so that the winding thereof is inserted in grooves between the adjacent convex portions 41 of the ferrite core 40. The horizontal deflection coil 47 is placed with its winding wound in a saddle-shape at a position closer to the Z-axis, compared with the vertical deflection coil 48. The insulating frame 49 placed between the vertical deflection coil 48 and the horizontal deflection coil 47 insulates both the coils from each other, and holds them. The horizontal deflection coil 47 generates a horizontal deflection magnetic field substantially along the Y-axis (second axis), and the vertical deflection coil 48 generates a vertical deflection magnetic field substantially along the X-axis (first axis).

The deflection yoke 4 thus configured is mounted on the outer circumferential surface of the funnel 2 of the color picture tube, whereby a color picture tube apparatus is configured, as shown in FIG. 1.

Next, the effect of Embodiment 1 will be described.

Figure 8:
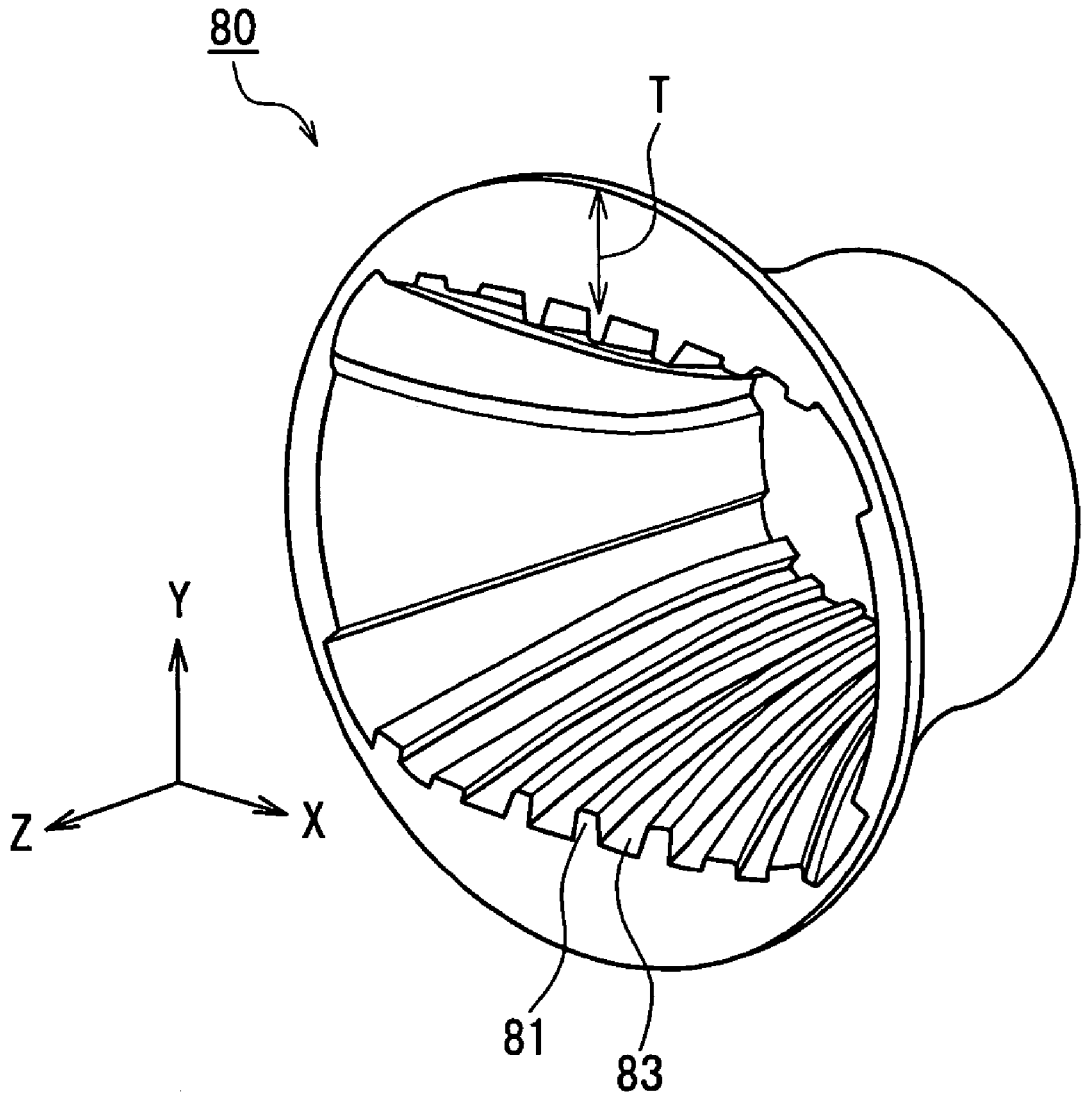
FIG. 8 is a perspective view of a ferrite core according to a Comparative Example.
Figure 9:
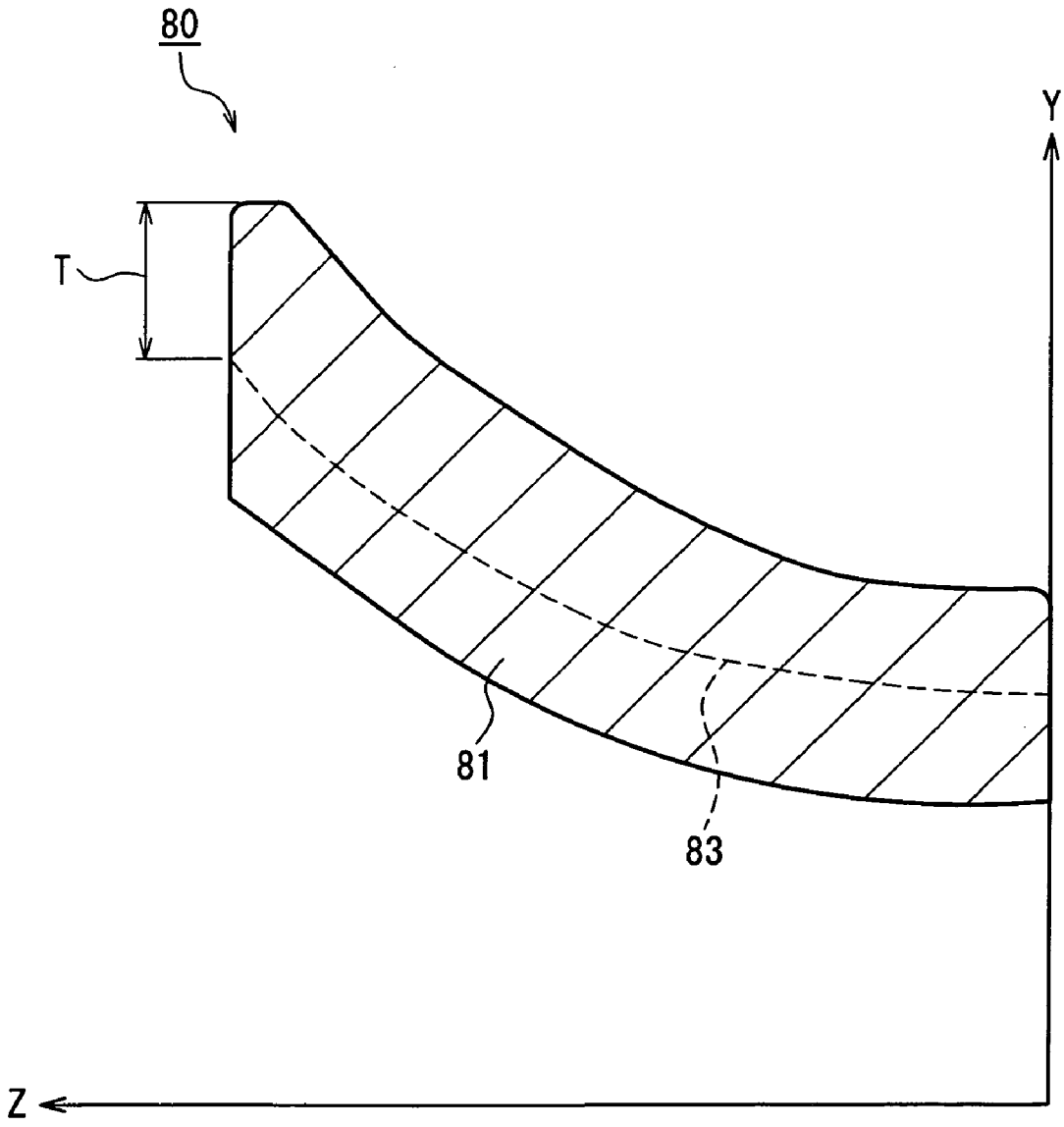
FIG. 9 is a partial cross-sectional view of the ferrite core according to a Comparative Example, taken along a surface including a center axis and a vertical axis.
Figure 19:
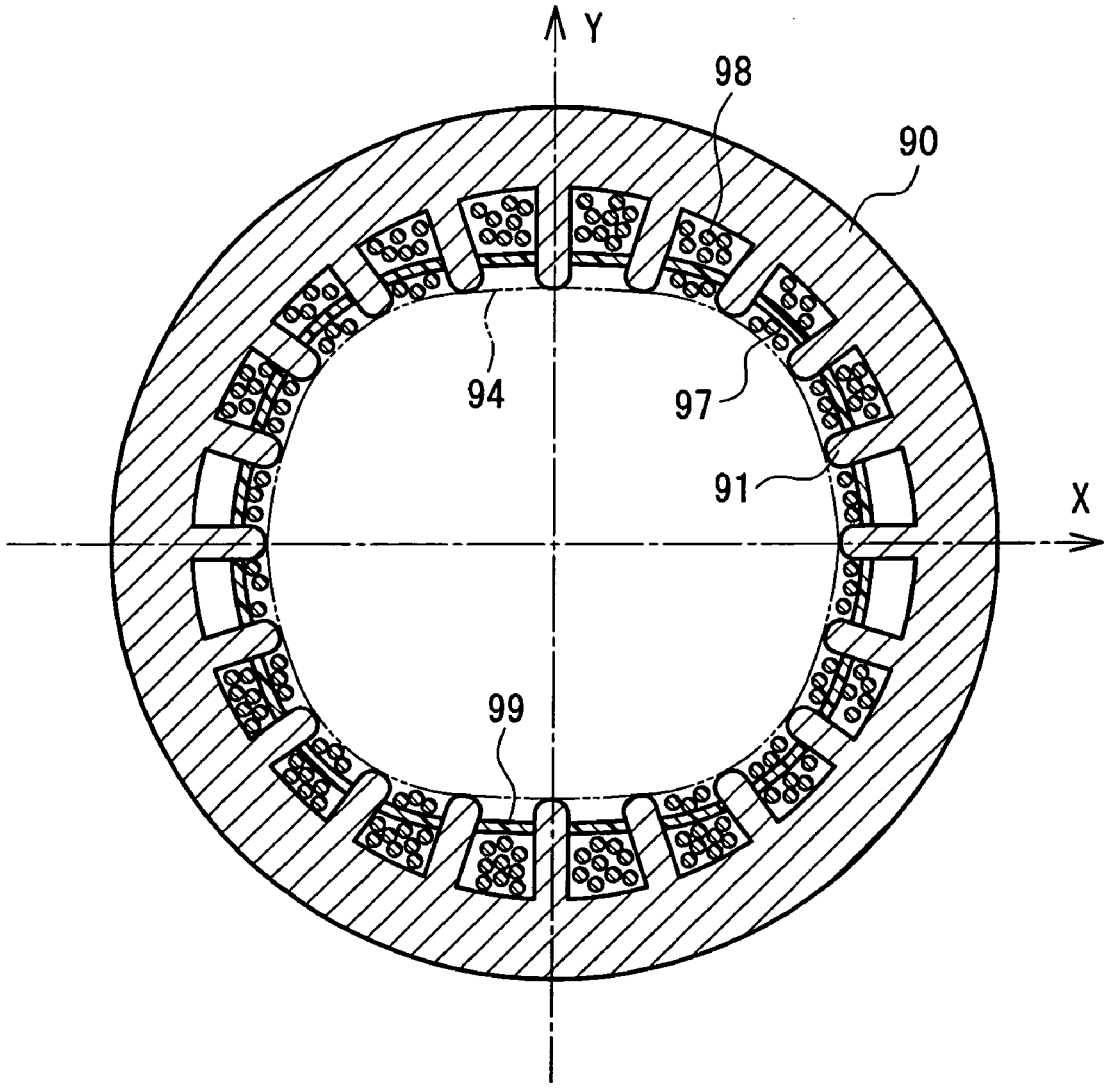
FIG. 19 PRIOR ART
FIG. 19 is a cross-sectional view of still another example of a deflection yoke having a conventional slot core, taken along a surface vertical to a tube axis.

As described above, in the conventional ferrite core 90 shown in FIG. 19, when the tip ends of the convex portions 91 are brought close to the outer circumferential surface of the funnel, the following problem arises: the protrusion length of the convex portions 91 becomes large, and the convex portions 91 are chipped. In order to solve the problem, the inventors of the present invention evaluated a ferrite core 80 as shown in FIG. 8. The ferrite core 80 is different from the ferrite core 90 shown in FIG. 19 in that the cross-sectional shape of an inner circumferential surface 83 excluding a plurality of convex portions 81 is substantially rectangular irrespective of the position in the Z-axis direction. FIG. 9 is a partial cross-sectional view on the YZ-plane of the ferrite core 80.

In the ferrite core 80, the protrusion length of the convex portions 81 can be set to be small, so that the problem regarding the chipping of the convex portions 91 of the ferrite core 90 shown in FIG. 19 can be solved. However, there is a problem that, particularly, a thickness T of a portion which the YZ-plane crosses in the vicinity of the end on the large diameter side becomes extraordinarily large compared with the thickness of the other portions, and in the sintering process of the ferrite core 80, the settable range of sintering conditions is small. This makes it difficult to sinter the entire ferrite core 80 uniformly. There also is a problem that the weight of the ferrite core 80 increases due to a thick portion with the thickness T. Furthermore, there is a problem that the increase in weight leads to an increase in cost.

The inventors of the present invention studied further, and came up with the ferrite core 40 of Embodiment 1.

The ferrite core 40 is a slot core provided with the plurality of convex portions 41 on the inner circumferential surface, in which an XY cross-sectional shape of the outer circumferential surface is substantially circular. The cross-sectional shape of the inner circumferential surface 43 of the ferrite core 40 excluding the plurality of convex portions 41 is substantially rectangular in a portion between the vicinity of the end on the small diameter side and the vicinity of the end on the large diameter side (see FIG. 5), and is substantially circular in the vicinity of the end on the large diameter side (see FIG. 6). Thus, as in Embodiment 1, the following configuration is made possible: while the convex portions 41 are provided in a portion where the inner circumferential surface 43 has a substantially rectangular cross-sectional shape in the Z-axis direction to obtain the effect of reducing a deflection power, the convex portions 41 are not provided in the region IV on the large diameter side of the ferrite core 40. Consequently, a thick portion such as that of the ferrite core 80 shown in FIG. 8 is not present at the end on the large diameter side of the ferrite core 40. This makes it easy to perform sintering in the sintering process. Furthermore, the weight of the ferrite core is not increased, and hence a cost does not increase. Furthermore, since the convex portions 41 are not present in the vicinity of the end on the large diameter side, the protrusion length of the convex portions 41 does not become long, and the convex portions 41 are not chipped.

Furthermore, the cross-sectional shape of the inner circumferential surface 43 is varied from a substantially circular shape in the region I at the end on the small diameter side to a substantially rectangular shape in the region II, so as to be matched with an XY cross-sectional shape of the outer circumferential surface of a funnel on which the ferrite core 40 is to be mounted. Therefore, in these regions, the tip ends of the convex portions 41 can be brought close to the outer circumferential surface of the funnel even without setting the protrusion length of the convex portions 41 to be extremely large. Thus, in these regions, the convex portions 41 are not chipped.

The ferrite core 40 is a slot core having the plurality of convex portions 41 on the inner circumferential surface. Therefore, the ferrite core 40 can be brought close to the picture tube in the same way as in the conventional slot core. Thus, the deflection efficiency can be enhanced, and the deflection power can be reduced.

Furthermore, since the winding of the vertical deflection coil 48 is inserted in the grooves 42 between the convex portions 41, a magnetic flux is unlikely to cross the vertical deflection coil 48. Thus, an eddy current loss is reduced, and the heat generated by the deflection yoke also can be reduced.

In Embodiment 1, the convex portions 41 are not present in the vicinity of the end on the large diameter side. However, in the Z-axis direction, the portion in the vicinity of the end on the large diameter side is originally far from the electron beams, compared with the other portions. Therefore, even if the convex portions 41 are not present in the vicinity of the end on the large diameter side, the effect intrinsic to the slot core can be obtained sufficiently.

The closed curve 44 obtained by successively connecting the tip ends of the plurality of convex portions 41 in the XY cross-section on at least one point on the Z-axis satisfies the relationship WH>WV, whereby the tip ends of the convex portions 41 can be brought as dose as possible to the outer circumferential surface of the funnel in which the XY cross-sectional shape is substantially rectangular. Thus, the deflection sensitivity is enhanced, and the deflection power can be reduced further.

Furthermore, the XY cross-sectional shape of the outer circumferential surface of the ferrite core 40 is substantially circular irrespective of the position in the Z-axis direction. Thus, a general-purpose common fixing jig can be used in the sintering process. Since a common fixing jig with the same heat capacity can be used even in the case of sintering a plurality of kinds of ferrite cores simultaneously, it is easy to set sintering conditions. Thus, the sintering process can be performed efficiently at a low cost. Furthermore, since the XY cross-sectional shape of the outer circumferential surface of the ferrite core 40 is substantially circular, the outer circumferential surface can be designed easily.

Thus, in the deflection yoke 4 provided with the ferrite core 40 of Embodiment 1, the enhancement of deflection sensitivity, the reduction in a deflection power, the reduction in heat generation, the enhancement of productivity, the reduction in cost, and the reduction in weight can be realized.

Furthermore, the color picture tube apparatus provided with the deflection yoke 4 can realize the low power consumption, low heat generation, low cost, and reduction in weight.

In the above-mentioned embodiment, the closed curve 44 defined in the XY cross-section at every point in a range of Z=0 to 36 mm satisfies the relationship WH>WV. However, the present invention is not limited thereto. The ferrite core 40 preferably has at least one XY cross-section in which the closed curve 44 satisfies the relationship WH>WV. In particular, it is preferable that the XY cross-section in which the closed curve 44 satisfies the relationship WH>WV is placed in a range in the Z-axis direction where the inner circumferential surface 43 is substantially rectangular. Owing to this preferable configuration, the protrusion length of the convex portions 41 can be reduced, so that the problem regarding the chipping and the like of the convex portions 41 can be reduced further.

Embodiment 2

Figure 10:
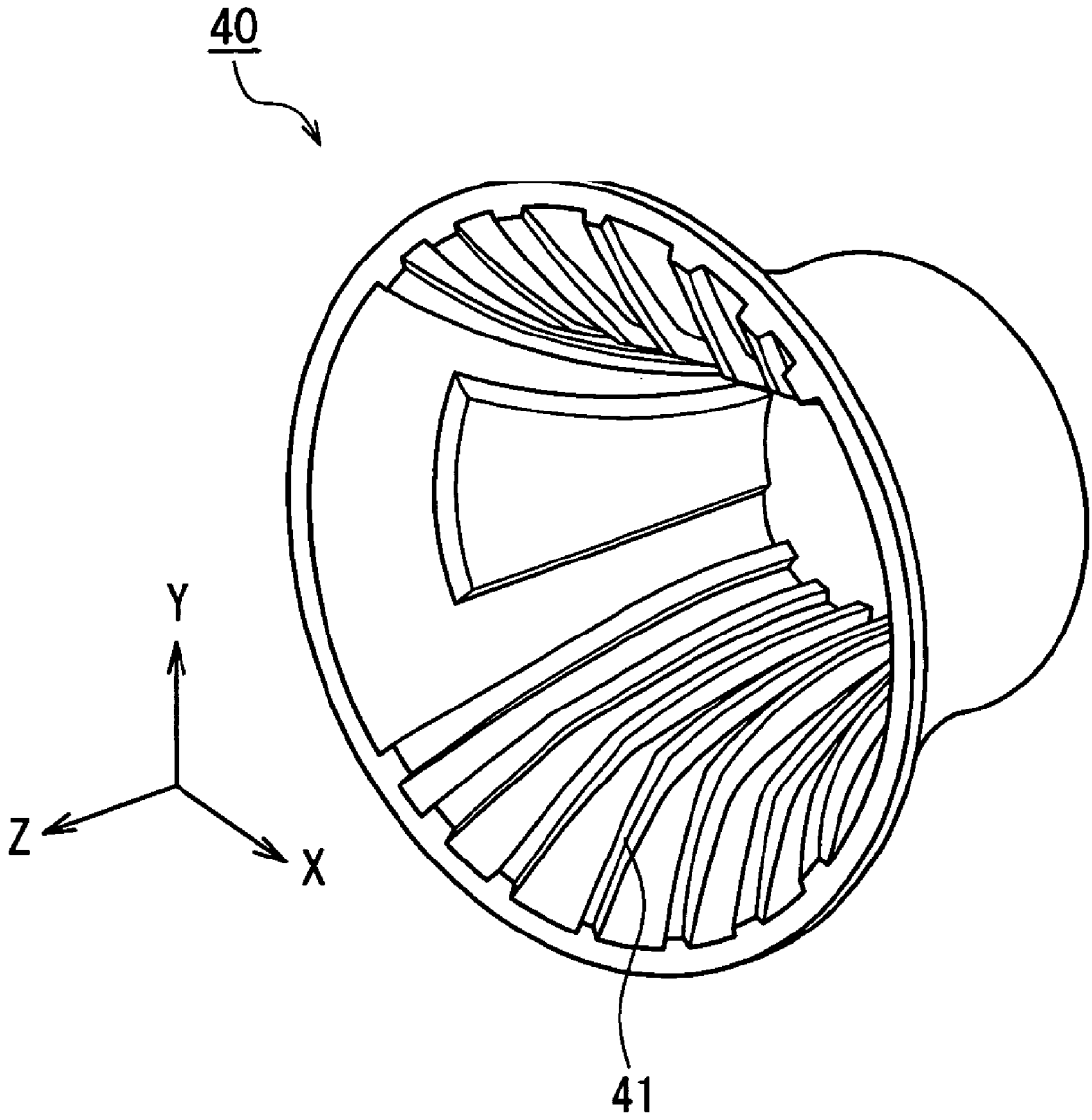
FIG. 10 is a perspective view of a ferrite core used in a deflection yoke according to Embodiment 2 of the present invention.
Figure 11:
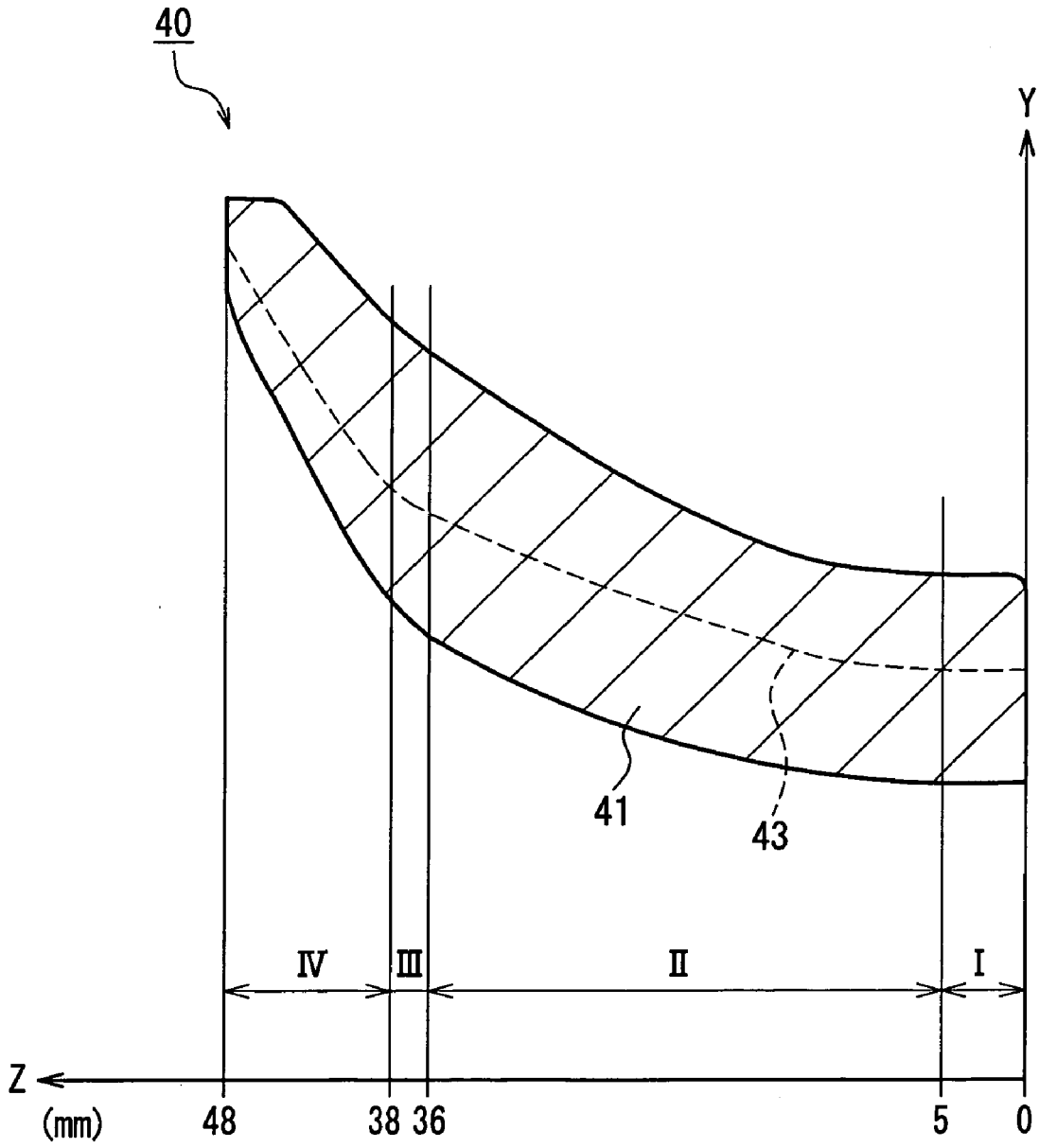
FIG. 11 is a partial cross-sectional view of the ferrite core according to Embodiment 2 of the present invention, taken along a surface including a center axis and a vertical axis.

FIG. 10 is a perspective view of the ferrite core 40 used in a deflection yoke according to Embodiment 2 of the present invention. FIG. 11 is a partial cross-sectional view of the ferrite core 40 on a YZ-plane according to Embodiment 2. As shown in FIGS. 10 and 11, the ferrite core 40 of Embodiment 2 is different from the ferrite core 40 of Embodiment 1 in that the convex portions 41 formed on the inner circumferential surface extend to the end on the large diameter side. The description of the portions common to those of Embodiment 1 is omitted here, and the present embodiment will be described mainly with respect to the difference from Embodiment 1.

Figure 12:
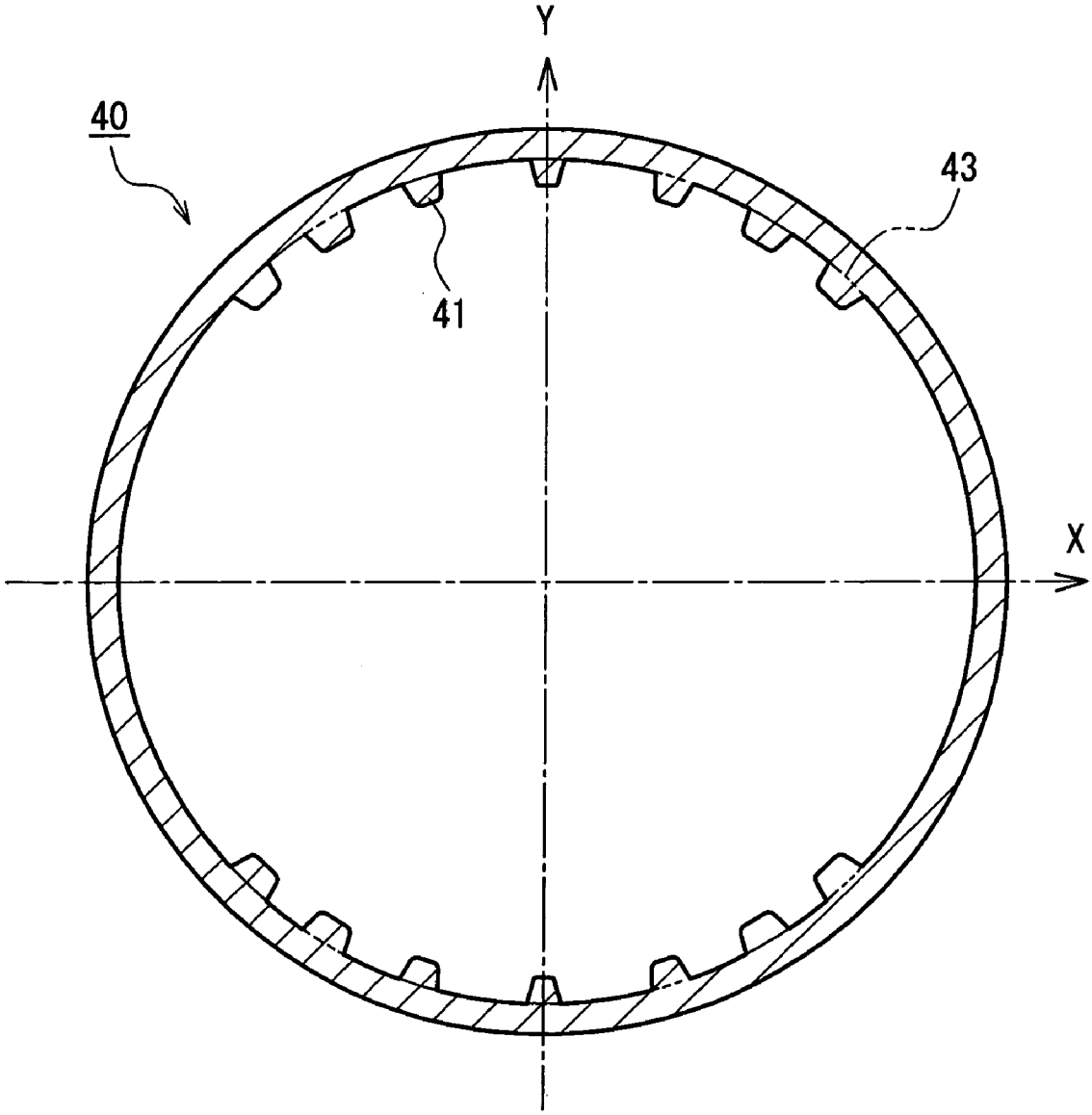
FIG. 12 is a cross-sectional view of the ferrite core according to Embodiment 2 of the present invention, taken along a surface vertical to the center axis at a position in the vicinity of an end on a large diameter side.

FIG. 12 is a cross-sectional view of the ferrite core 40 on an XY-plane at a position (Z=43 mm) in the vicinity of the end on the large diameter side. As is apparent from the comparison with FIG. 6 showing the XY cross-section of the ferrite core 40 of Embodiment 1 at the same position as that in FIG. 12, the convex portions 41 also are formed in a region (Z=38 to 48 mm) on the large diameter side of the ferrite core 40 in Embodiment 2. The XY cross-sectional view at a position (Z=3 mm) in the vicinity of the end on the small diameter side of the ferrite core 40 of Embodiment 2 and the XY cross-sectional view at a substantially center position (Z=25 mm) are the same as FIGS. 4, and 5, respectively. Furthermore, the XY cross-sectional view at the position (Z=25 mm) of the deflection yoke 4 according to Embodiment 2 provided with the ferrite core 40 of Embodiment 2 is the same as that shown in FIG. 7.

Embodiment 2 also exhibits the same effect as that of Embodiment 1.

In the same way as in Embodiment 1, the closed curve 44 defined in the XY cross-section at every point in a range of Z=0 to 36 mm satisfies the relationship WH>WV. Therefore, the effect intrinsic to the slot core is exhibited sufficiently. Thus, the protrusion length of the convex portions 41 in the vicinity of the end on the large diameter side can be set to be small, so that the convex portions 41 can be prevented from being chipped. If the protrusion length of the convex portions 41 in the vicinity of the end on the large diameter side is set to be as large as possible, the deflection efficiently is enhanced, and the deflection power can be reduced.

Embodiment 3

Figure 13:
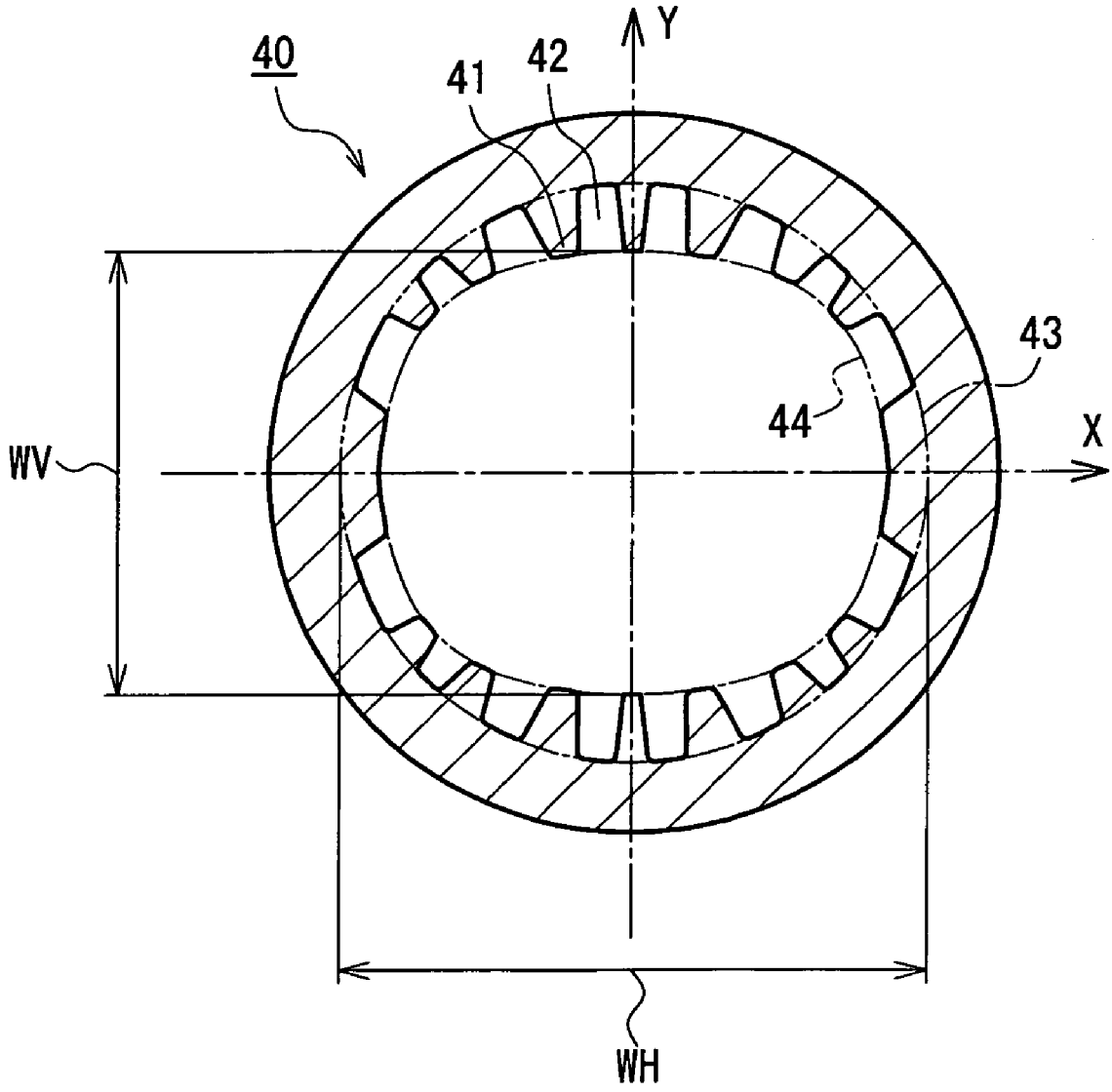
FIG. 13 is a cross-sectional view of a ferrite core according to Embodiment 3 of the present invention, taken along a surface vertical to a center axis at a position in the vicinity of an end on a small diameter side.
Figure 14:
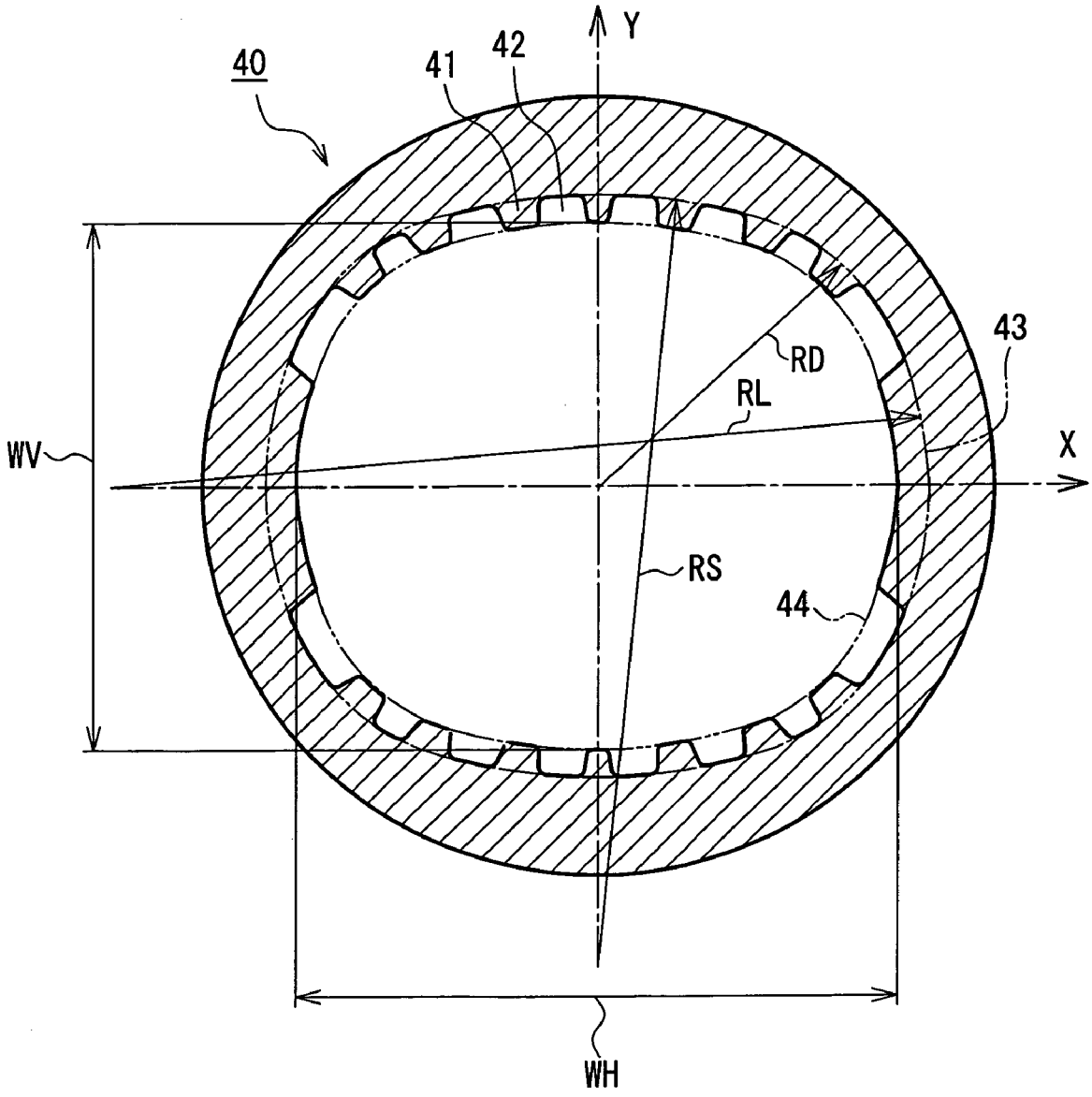
FIG. 14 is a cross-sectional view of the ferrite core according to Embodiment 3 of the present invention, taken along a surface vertical to the center axis in a substantially center portion in a center axis direction.
Figure 15:
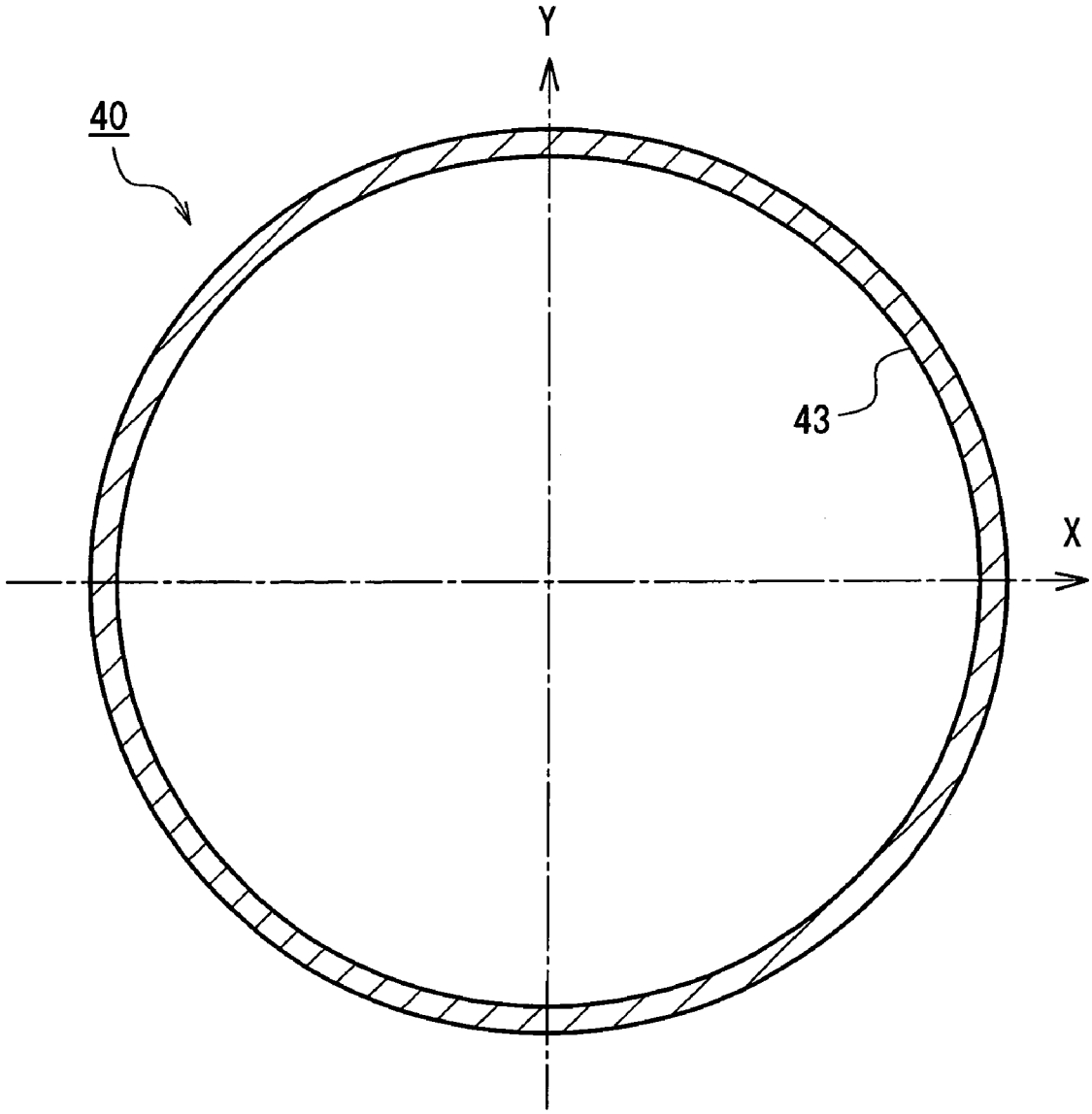
FIG. 15 is a cross-sectional view of the ferrite core according to Embodiment 3 of the present invention, taken along a surface vertical to the center axis at a position in the vicinity of an end on a large diameter side.

FIG. 13 is an XY cross-sectional view at a position (Z=3 mm) in the vicinity of the end on the small diameter side of the ferrite core 40 according to Embodiment 3 of the present invention. FIG. 14 is an XY cross-sectional view at a substantially center position (Z=25 mm) of the ferrite core 40 according to Embodiment 3 of the present invention. FIG. 15 is an XY cross-sectional view at a position (Z=43 mm) in the vicinity of the end on the large diameter side of the ferrite core 40 according to Embodiment 3 of the present invention.

The ferrite core 40 of Embodiment 3 is different from the ferrite core 40 of Embodiment 1 in that the closed curve (envelope curve of the tip ends of the convex portions 41) 44 obtained by successively connecting the tip ends of the plurality of convex portions 41 is substantially rectangular in the XY cross-section. The size in the Y-axis direction of the closed curve 44 has a maximum value WV on the Y-axis. The closed curve 44 defined in the XY cross-section at every point in a range of Z=0 to 36 mm satisfies the relationship WH>WV, which is the same as that in the ferrite core 40 of Embodiment 1.

Figure 16:
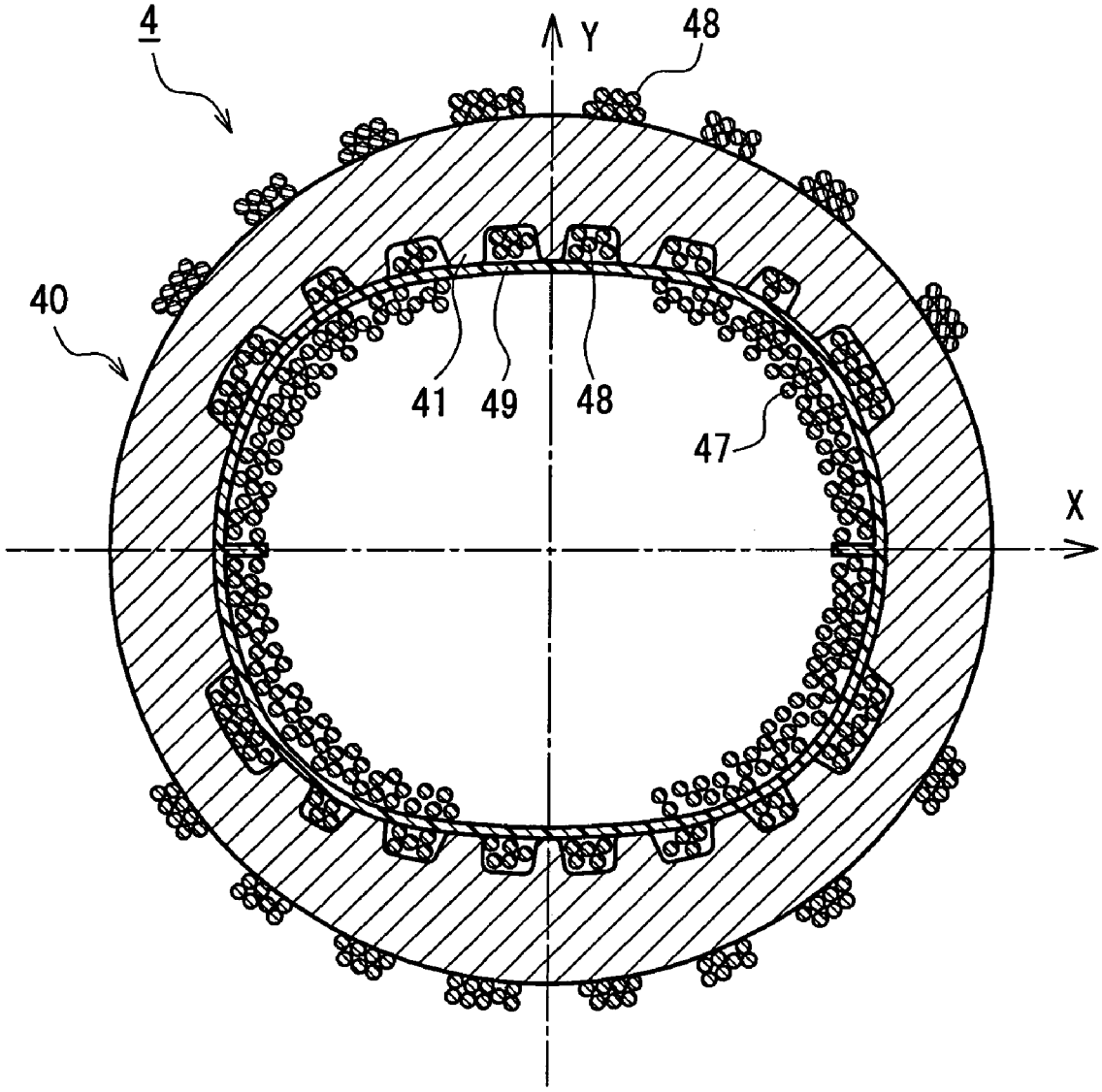
FIG. 16 is a cross-sectional view of a deflection yoke according to Embodiment 3 of the present invention, taken along a surface vertical to a center axis in a substantially center portion in a center axis direction.

FIG. 16 is an XY cross-sectional view at a position (Z=25 mm) of the deflection yoke 4 according to Embodiment 3 provided with the ferrite core 40 of Embodiment 3. An insulating frame 49 has a substantially rectangular XY cross-sectional shape that follows the substantially rectangular closed curve 44.

Embodiment 3 is the same as Embodiment 1 except for the above, and exhibits the same effect as that of Embodiment 1.

Figure 17:
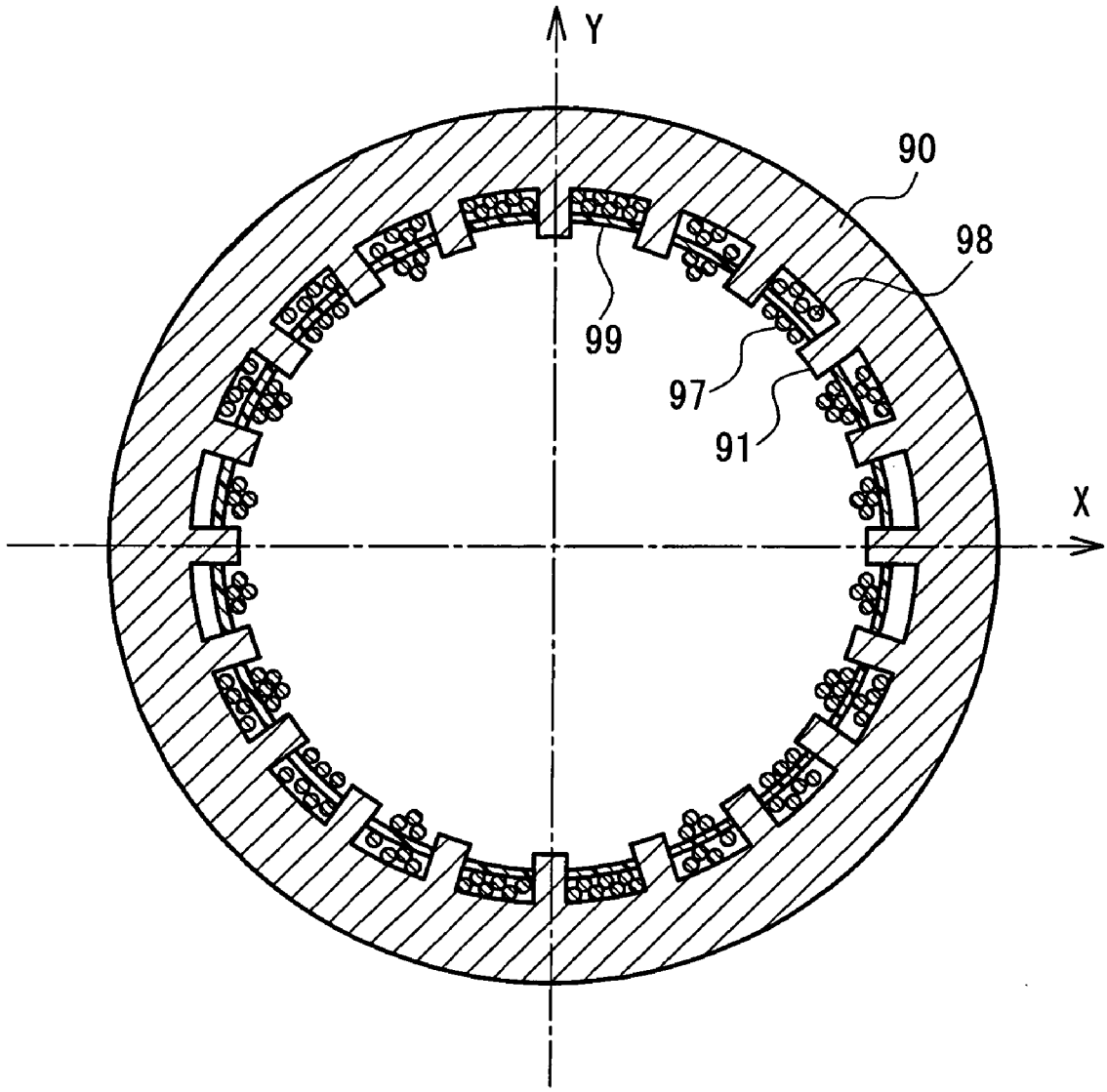
FIG. 17 PRIOR ART
FIG. 17 is a cross-sectional view of an example of a deflection yoke having a conventional slot core, taken along a surface vertical to a tube axis.
Figure 18:
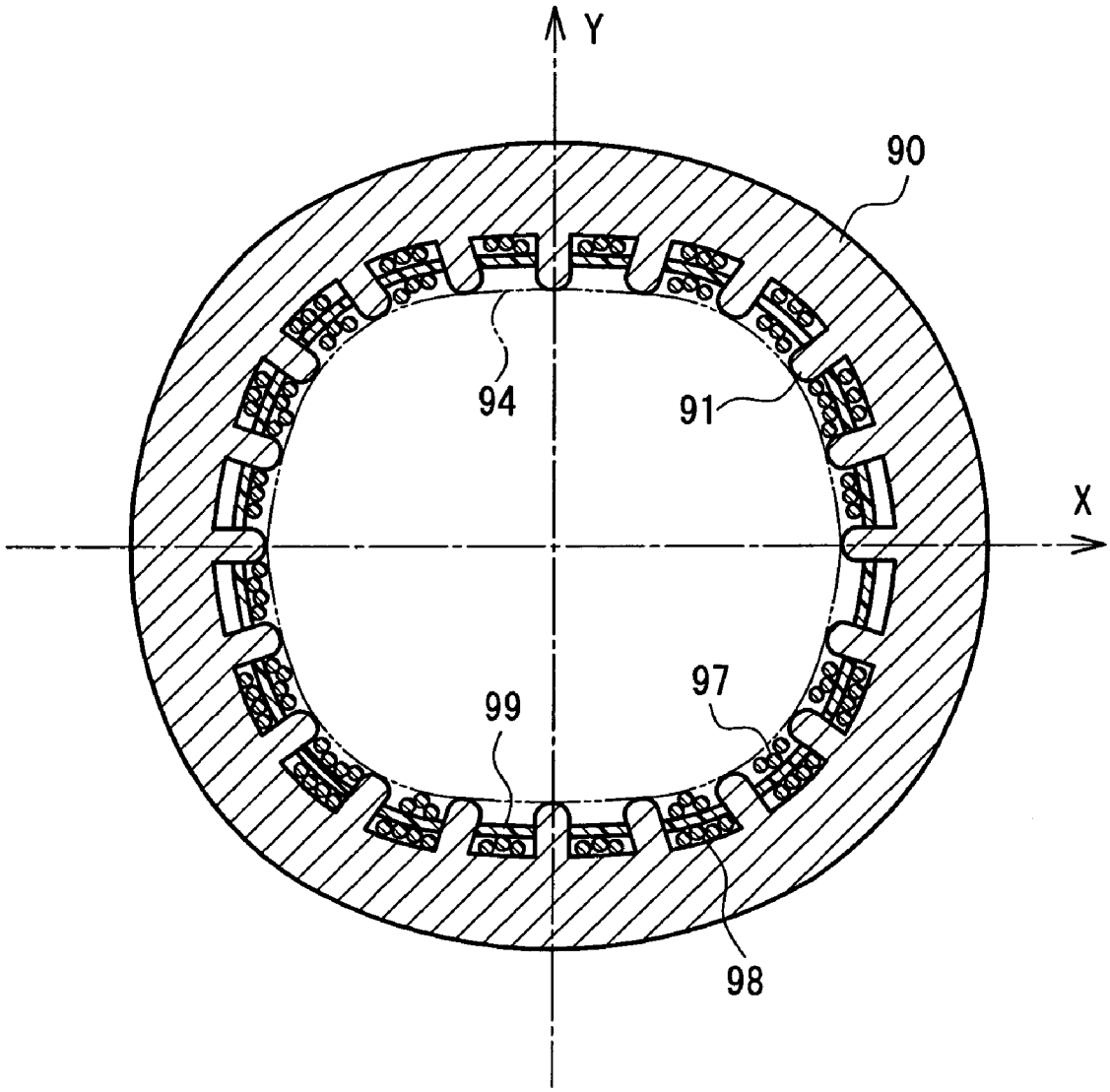
FIG. 18 PRIOR ART
FIG. 18 is a cross-sectional view of another example of a deflection yoke having a conventional slot core, taken along a surface vertical to a tube axis.

In Embodiments 1 to 3, the winding of the horizontal deflection coil 47 may be wound so as to be inserted in the grooves 42 between the convex portions 41 in the same way as in FIGS. 17 to 19. This reduces a magnetic flux that crosses the horizontal deflection coil 47, so that an eddy current loss and heat generation can be reduced further.

In Embodiments 1 to 3, the plurality of convex portions 41 all protrude substantially toward the Z-axis. However, the present invention is not limited thereto. For example, in the XY cross-section, the convex portions 41 may protrude substantially in parallel to the X-axis or the Y-axis.

In the present invention, the expression that the convex portions "have a ridge shape in a direction connecting an end on a small diameter side of the ferrite core to an end on a large diameter side thereof" refers to a schematic direction in which the ridge-shaped convex portions 41 extend. The direction of the ridge-shaped convex portions 41 does not need to be substantially along a plane that includes the Z-axis, as described in Embodiments 1 to 3. For example, a position in the circumferential direction with respect to the Z-axis of the convex portions 41 in the XY cross-section may be varied depending upon the position in the Z-axis direction. More specifically, the convex portions 41 may extend in a spiral shape from the end on the small diameter side of the ferrite core 40 to the end on the large diameter side thereof.

The convex portions do not need to be present over the entire region between the end on the small diameter side and the end on the large diameter side, and there may be a region where the convex portions are not present in the vicinity of the end on the small diameter side, in the vicinity of the end on the large diameter side, or in one or a plurality of sections between the vicinity of the end on the small diameter side and the vicinity of the end on the large diameter side.

In Embodiments 1 to 3, the cross-sectional shape in the XY cross-section of the inner circumferential surface 43 of the ferrite core 40 excluding the plurality of convex portions 41 in the vicinity of the end on the small diameter side is substantially circular. However, the present invention is not limited thereto. For example, the above-mentioned cross-sectional shape may be substantially rectangular. In general, the XY cross-sectional shape of the outer circumferential surface of the funnel 2 at a position, where the vicinity of the end on the small diameter side of the ferrite core 40 is opposed to, is substantially circular. Therefore, it is preferable that the XY cross-sectional shape of the inner circumferential surface 43 of the ferrite core 40 in the vicinity of the end on the small diameter side is substantially circular, since the ferrite core 40 can be brought close to the electron beams.

In Embodiments 1 to 3, the closed curve 44 obtained by successively connecting the tip ends of the plurality of convex portions 41 satisfies the relationship WH>WV in the XY cross-section on at least one point on the Z-axis. However, the present invention is not limited thereto. For example, the closed curve 44 may be circular irrespective of the position in the Z-axis direction, although the effect of reducing a deflection power is degraded compared with those of Embodiments 1 to 3.

In the present invention, the cross-sectional shape of the inner/outer circumferential surface of the ferrite core 40 being "substantially circular" in the XY cross-section refers to the shape that can be determined to be substantially circular, and includes, for example, the case where distortion based on a production error is present, and the case where minute protrusions and dents are present on a surface.

The applicable field of the present invention is not particularly limited, and the present invention can be applied widely to a color picture tube apparatus, for example, in a television, a computer display, or the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A ferrite core having a substantially funnel shape, comprising a plurality of convex portions arranged on an inner circumferential surface in a circumferential direction, wherein all the convex portions have a ridge shape in a direction connecting an end on a small diameter side of the ferrite core to an end on a large diameter side thereof, in a cross-section orthogonal to a center axis of the ferrite core, a cross-sectional shape of an outer circumferential surface of the ferrite core is substantially circular, and in a cross-section orthogonal to the center axis, a cross-sectional shape of an inner circumferential surface of the ferrite core excluding the plurality of convex portions is substantially circular in a vicinity of the end on the large diameter side and is substantially rectangular in a portion between the vicinity of the end on the small diameter side and the vicinity of the end on the large diameter side.

2. The ferrite core according to claim 1, wherein assuming that, in a cross-section orthogonal to the center axis on at least one point on the center axis, a size on a first axis orthogonal to the center axis of a closed curve obtained by successively connecting tip ends of the plurality of convex portions is WH, and a size on a second axis orthogonal to the center axis and the first axis of the closed curve is WV, a relationship WH>WV is satisfied.

3. The ferrite core according to claim 2, comprising the cross-section in which the relationship WH>WV is satisfied, in a range on the center axis having a cross-section in which a cross-sectional shape of the inner circumferential surface excluding the plurality of convex portions is substantially rectangular.

4. The ferrite core according to claim 1, wherein in a cross-section orthogonal to the center axis in the vicinity of the end on the small diameter side, the cross-sectional shape of the inner circumferential surface of the ferrite core excluding the plurality of convex portions is substantially circular.

5. A deflection yoke, comprising:

the ferrite core of claim 1;

a vertical deflection coil for generating a vertical deflection magnetic field substantially along a first axis orthogonal to the center axis;

a horizontal deflection coil for generating a horizontal deflection magnetic field substantially along a second axis orthogonal to the center axis and the first axis; and an insulating frame for insulating the vertical deflection coil from the horizontal deflection coil.

6. A color picture tube apparatus, comprising:

an envelope composed of a front panel and a funnel;

an electron gun for emitting an electron beam, housed in a neck of the funnel; and a deflection yoke for deflecting the electron beam in a horizontal direction and a vertical direction, mounted on an outer circumferential surface of the funnel, wherein the deflection yoke is the deflection yoke of claim 5.

* * * * *